US008770549B2

(12) United States Patent
Deuring et al.

(10) Patent No.: US 8,770,549 B2
(45) Date of Patent: Jul. 8, 2014

(54) LOCKING DEVICES

(75) Inventors: Thomas Deuring, Hopferbach (DE); Thomas Grotzinger, Immenstadt (DE); Jurgen Grotz, Wiggensbach (DE)

(73) Assignee: MAHA Maschinenbau Haldenwang GmbH & Co. KG (DE)

( * ) Notice: Subject to any disclaimer, the term of this patent is extended or adjusted under 35 U.S.C. 154(b) by 898 days.

(21) Appl. No.: 12/946,564

(22) Filed: Nov. 15, 2010

(65) Prior Publication Data

US 2011/0278517 A1 Nov. 17, 2011

Related U.S. Application Data

(63) Continuation of application No. PCT/DE2009/000700, filed on May 15, 2009.

(30) Foreign Application Priority Data

May 16, 2008 (DE) ..... 10 2008 024 051

(51) Int. Cl.
*B66F 7/06* (2006.01)

(52) U.S. Cl.
USPC ..... 254/122; 254/126

(58) Field of Classification Search
USPC ..... 254/122–126, 134, 103
See application file for complete search history.

(56) References Cited

U.S. PATENT DOCUMENTS 1,545,223 A * 7/1925 Westrate ..... 254/126
2,361,690 A * 10/1944 Hunz ..... 254/110

(Continued)

FOREIGN PATENT DOCUMENTS

DE 2745639 A1 4/1979
DE 20 2007 014 662 U1 1/2008

(Continued)

OTHER PUBLICATIONS

Patent Cooperation Treaty, "International Search Report," issued by the International Searching Authority in connection with related PCT application No. PCT/DE2009/000700, issued Sep. 2, 2009 (4 pages).
Patent Cooperation Treaty, "Written Opinion of the International Searching Authority," issued by the International Searching Authority in connection with related PCT application No. PCT/DE2009/000700, issued Sep. 2, 2009 (5 pages).

(Continued)

*Primary Examiner* — Lee D Wilson
(74) *Attorney, Agent, or Firm* — Hanley, Flight and Zimmerman, LLC

(57) ABSTRACT

Example methods, apparatus, system, and articles of manufacture for releasably locking components that are moveable relative to one another are disclosed herein. A disclosed example locking apparatus includes a locking device mountable to a first component and including at least one locking member. The example system also includes a catch member mountable to a second component. The catch member has a plurality of substantially similarly formed catches. The locking member is engageable with at least one catch in a plurality of predetermined catching positions in at least one of a releasable, form-locking manner or a releasable, force-locking manner. The example system also includes a force member to produce a relative movement between the locking member and the at least one catch. In at least a partial region of the catch member, at least a first catching position, a second catching position and a third catching position are traversable by the locking member. At least a first distance between the first catching position and the second catching position and a second distance between the second catching position and the third catching position have different lengths.

18 Claims, 4 Drawing Sheets

(56) References Cited

U.S. PATENT DOCUMENTS

| | | | | |
|---|---|---|---|---|
| 2,555,350 | A * | 6/1951 | Lloyd | 254/124 |
| 2,611,579 | A * | 9/1952 | Guzey, Jr. et al. | 254/8 B |
| 2,739,849 | A | 3/1956 | Lynn | |
| 3,317,004 | A | 5/1967 | Harrison, Jr. | |
| 3,334,866 | A * | 8/1967 | Bergamino | 254/108 |
| 3,704,860 | A * | 12/1972 | Krapu | 254/95 |
| 4,899,987 | A * | 2/1990 | Craig | 254/122 |
| 5,004,075 | A | 4/1991 | Ascenzo | |
| 5,050,844 | A | 9/1991 | Hawk | |
| 2007/0170407 | A1* | 7/2007 | Ruan | 254/108 |
| 2010/0243973 | A1* | 9/2010 | Deuring et al. | 254/122 |
| 2011/0278517 | A1* | 11/2011 | Deuring et al. | 254/122 |
| 2013/0256611 | A1* | 10/2013 | Ruth | 254/122 |

FOREIGN PATENT DOCUMENTS

| | | | |
|---|---|---|---|
| DE | 202007004524 | U1 | 8/2008 |
| DE | 10 2007 023 184 | A1 | 11/2008 |
| EP | 1302437 | A1 | 4/2003 |
| WO | 2009/138078 | A1 | 11/2009 |

OTHER PUBLICATIONS

German Patent and Trademark Office, "Search Report," issued in connection with German Application No. 10 2008 024 051.6, dated Nov. 20, 2008, (4 pages).

* cited by examiner

LOCKING DEVICES

RELATED APPLICATIONS

This patent is a continuation of International Patent Application No. PCT/DE2009/000700, filed on May 15, 2009, which claims the benefit of German Patent Application No. 10 2008 024 051.6, filed on May 16, 2008, both of which are incorporated herein by reference in their entireties.

FIELD OF THE DISCLOSURE

The present disclosure relates generally to lifting devices and, more particularly, to locking devices for releasably locking components that are moveable relative to one another.

BACKGROUND

In traditional lifting platforms, a ratchet mechanism is displaced relative to a toothed rack, and the ratchet mechanism engages the toothed rack when a catching position is reached. Uniform pitches of teeth on the toothed rack provide a plurality of equidistant catching positions to lock or fix the ratchet mechanism relative to the toothed rack. In a scissors-type lifting platform having two scissors bars approximately centrally connected to each other via a pivot joint, one of the scissors bars is respectively rotatably connected to a rail at its upper end and is longitudinally displaceably supported on a base at its lower end. The second scissors bar is rotatably connected to the base at its lower end and longitudinally displaceably connected to a rail at its upper end. The displaceably supported ends of the scissors bars are connected to a ratchet member that is displaceable along a toothed rack.

However, in such lifting platforms, the linearly guided ends of the scissors bars move along a curved path during a lifting or lowering movement of the scissors-type lifting platform. As a result, lateral displacements of the ratchet mechanism from one catching position to the next catching position in equal amounts produce vertical lifting movements that become increasingly smaller as the lifting platform is moved from one catching position to the next catching position. Due to the plurality of available catching positions, it is difficult to cause the lifting platform to catch such that predetermined, equidistant lifting positions are achieved.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples.

Example locking devices disclosed herein for releasably locking components that are movable relative to each other may advantageously be used in lifting devices or lifting platforms. Example locking devices disclosed herein enable operating lifting platforms to provide equidistant predetermined lifting positions. Such disclosed example locking devices enable releasably locking to each other two parts that are linearly movable relative to one another. Such disclosed example locking devices also prevent unintended catching of the locking device that would otherwise cause blocking or failure of the apparatus on which the locking device is provided.

Figure 1:
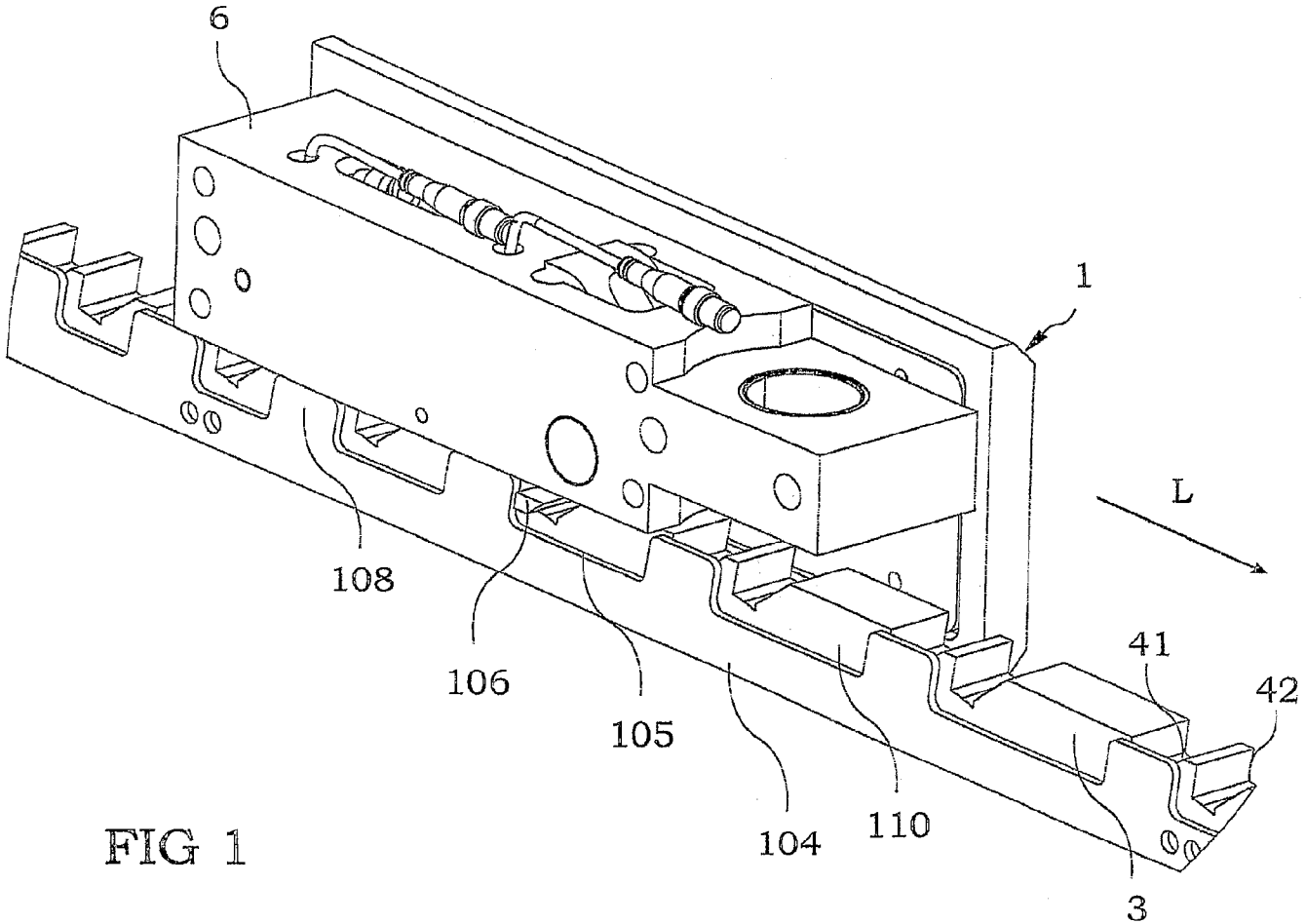
FIG. 1 depicts a perspective view of an example locking device.

An example locking device 1 is illustrated in FIG. 1. The locking device 1 includes a dimensionally stable or uniform housing 6 having a locking member 2 (shown in FIG. 1) located therein. The locking member 2 can engage a catch member 3. The catch member 3 has identically formed catches 4 (shown in FIG. 4A), each of which has a first catch unit 41 and a second catch unit 42. A guide unit 104 is provided on a side surface 110 of the catch member 3 and includes planar elevations 108. The distances between the elevations 108 substantially correspond to the distances between the catches 4. The guide unit 104 is aligned with the catch member 3 such that its elevations 108 laterally cover or extend across the second catch unit 42 of the catches 4, respectively, as shown along the side surface 110. As also shown in FIG. 1, an actuation means 106 is connected to the guide unit 104 and is configured to contact the locking member 2. During a lateral or horizontal movement of the locking device 1 along the length of the catch member 3 in a direction generally indicated by arrow L, the actuation means 106 comes into contact with or engages the contour 105 of the guide unit 104 at a region of the elevations 108. Such contacting or engagement causes the actuation means 106 to block the locking member 2, thus preventing extension of the locking member 2 into a corresponding one of the second catch units 42.

Figure 2:
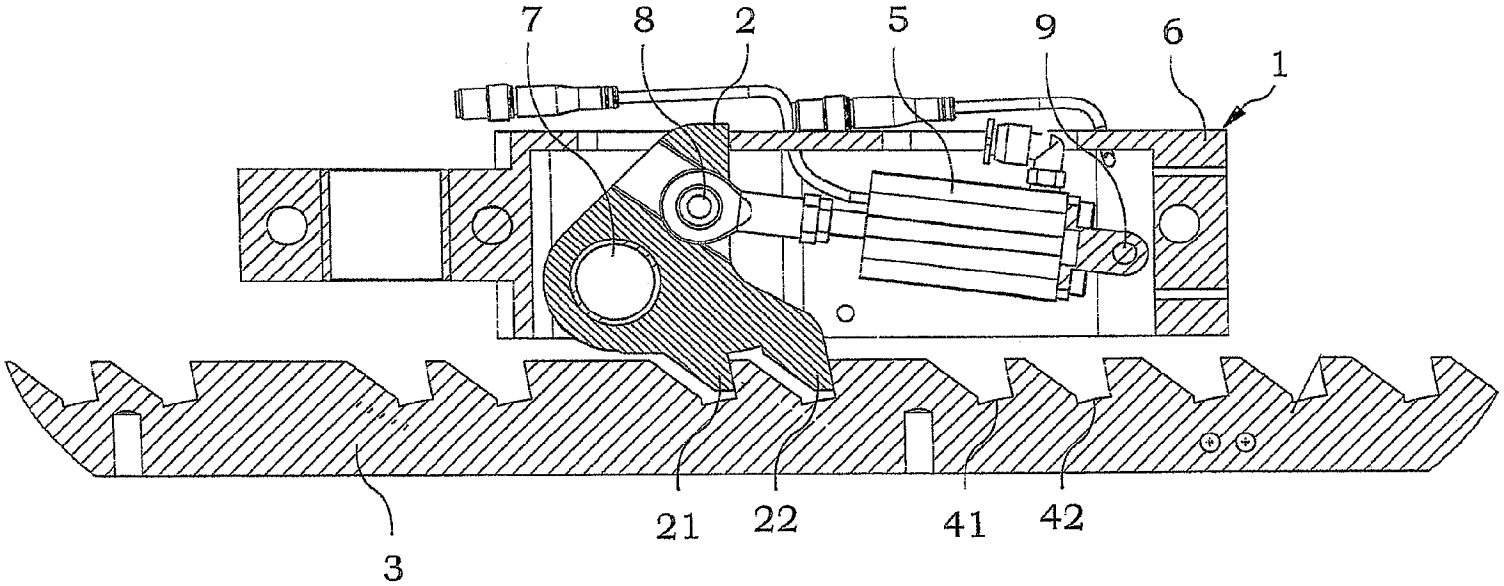
FIG. 2 depicts a longitudinal sectional view of the example locking device of FIG. 1.

FIG. 2 shows a longitudinal sectional view of the locking device 1 of FIG. 1. The locking device 1 is provided with a force member 5 located in the housing 6. The force member 5 may be a hydraulic or pneumatic cylinder. At a first end region of the force member 5, the force member 5 is connected to the housing 6 via a pivot joint 9. At a second end region of the force member 5, the force member 5 is connected to the locking member 2 via a pivot joint 8. The locking member 2 is rotatably coupled to the housing 6. Actuating the force member 5 causes the locking member 2 to rotate about a rotational axis 7, thus retracting the locking member 2 into the housing 6 or extending the locking member 2 from the housing 6 to transfer or move the locking member 2 between locking (or arresting) and unlocking positions.

As shown in FIG. 2, the locking member 2 has two teeth, a first tooth 21 and a second tooth 22, which are respectively engaged with a first catch unit 41 and a second catch unit 42 of a catch 4 (FIG. 4A) in a locking or arresting position.

Figure 3:
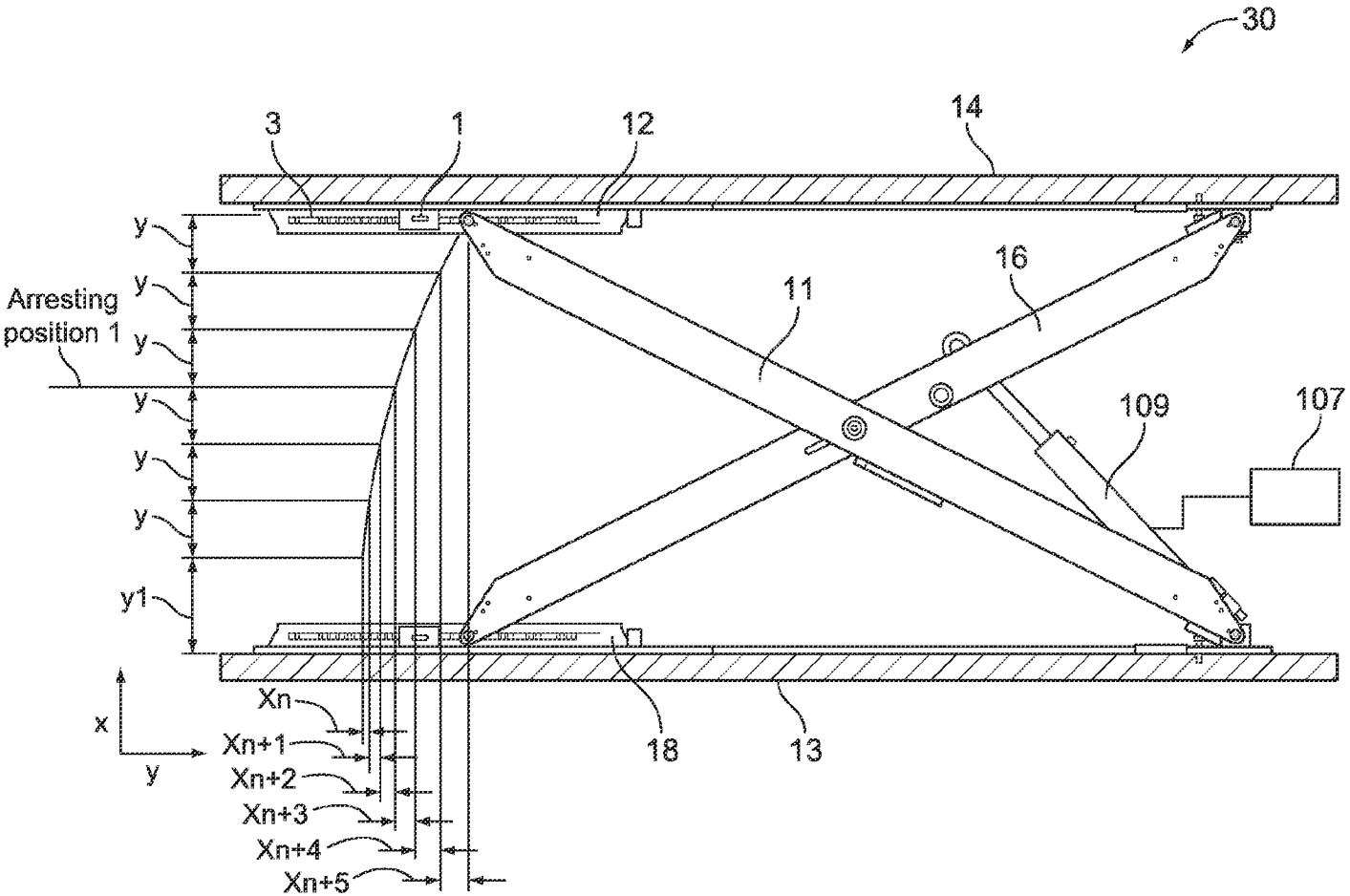
FIG. 3 depicts a scissors-type lifting platform with the example locking device of FIGS. 1 and 2.

FIG. 3 shows a side view of a scissors-type lifting platform 30 having the locking device 1 of FIGS. 1 and 2 mounted thereto for use therewith. As shown, the locking device 1 is mounted to a first component 11 at a laterally displaceable upper end thereof. In the illustrated example of FIG. 3, the first component 11 is a scissors bar. The catch member 3 is mounted to a second component 12. The first component 11 is rotatably coupled at its lower end to a third component 13. In the illustrated example of FIG. 3, the third component 13 is a base or bottom plate. In the illustrated example of FIG. 3, the second component 12 is a bracket fixedly coupled to the catch member 3 and to a fourth component 14 such as, for example, a rail.

An assembly for a second scissors bar 16 is also shown in FIG. 3. A laterally displaceable lower end of the second scissors bar 16 is connected to a second locking device 18 that is substantially similar or identical to the locking device 1. An upper end of the second scissors bar 16 is rotatably coupled to the rail 14. In the illustrated example of FIG. 3, the illustrated scissors-type lifting platform 30 is moveable or adjustable along a vertical path at intervals of uniform or equidistant, vertical distances y corresponding to respective catching positions from a particular starting height y1. To enable the equidistant distances y, catch rails (e.g., the catch member 3) of the locking devices 1 and 18 are provided with teeth separated from one another at a variable pitch along the horizontal direction. As the lifting height of the rail 14 increases vertically, the pitch of the teeth on the catch rails (e.g., the catch member 3) increases in a lateral or horizontal direction as shown by the distances xn, xn+1, xn+2, x . . . , wherein xn<xn+1<xn+2<x . . . .

As also shown in FIG. 3, the scissors-type lifting platform 30 is provided with a lifting assembly 108 and a control unit 107 operatively coupled to the lifting assembly 109. The lifting assembly 109 is operatively coupled to the two scissors bars 11 and 16 of the scissors-type lifting platform 30 such that it is capable of actuating the spreading of the scissors bars 11 and 16 relative to one another and/or actuating the closing of the scissors bars 11 and 16 relative to one another. In the illustrated example of FIG. 3, the control unit 107 drives the lifting assembly 109 and drives the force member 5 (FIG. 2) in the locking device 1.

If the lifting platform 30 is to be lifted and to be locked or arrested in a locking, catching or arresting position 1, which corresponds to a height resulting from the value y1+3*y, the control unit 107 drives the lifting assembly 109 such that the lifting height is moved to a first lifting height, which is substantially slightly higher than the arresting position 1, however lower than a lifting height corresponding to the value y1+4*y. When this first lifting height is reached, the control unit 107 drives the force member 5 such that the teeth 21, 22 of the locking member 2 penetrate or engage the depressions of the catch units 41, 42 by rotating the locking member 2 out of the housing 5. Subsequently, the control unit 107 drives the lifting assembly 109 such that the rail 14 performs a lowering movement and adopts, stops, or rests at the arresting position 1, at which the teeth 21 and 22 are fixedly engaged with the catch units 41 and 42.

To release and move the lifting platform 30 from the arresting position 1, the control unit 107 drives the lifting assembly 109 such that first a slight lifting movement is performed. The slight lifting movement moves the rail 14 to a lifting height that is higher than a height corresponding to the height value y1+3*y and is lower than a height corresponding to the height value y1+4*y, but is at least sufficiently high to transfer or move the locking member 2 into an unlocking position. At the height resulting from the slight lifting movement, the force member 5 of the locking device 1 is driven such that the locking member 2 is rotated into the housing 6 and thereby becomes positioned in the unlocking position.

Although in FIG. 3 both of the locking devices 1 and 18 are provided on the laterally displaceable ends of both scissors bars 11 and 16, alternative example lifting platforms may be implemented using only one locking device (e.g., the locking device 1) coupled to one scissors bar (e.g., the scissors bar 11). In such alternative example lifting platforms, a guide is attached to the displaceably supported end of the other scissors bar (e.g., the scissors bar 16). Optionally, the locking device 1 can be coupled between the upper displaceably supported end of the scissors bar 11 and the rail 14 or be coupled between the lower laterally displaceable end of the scissors bar 16 and the base or bottom plate 13.

Figure 4A:
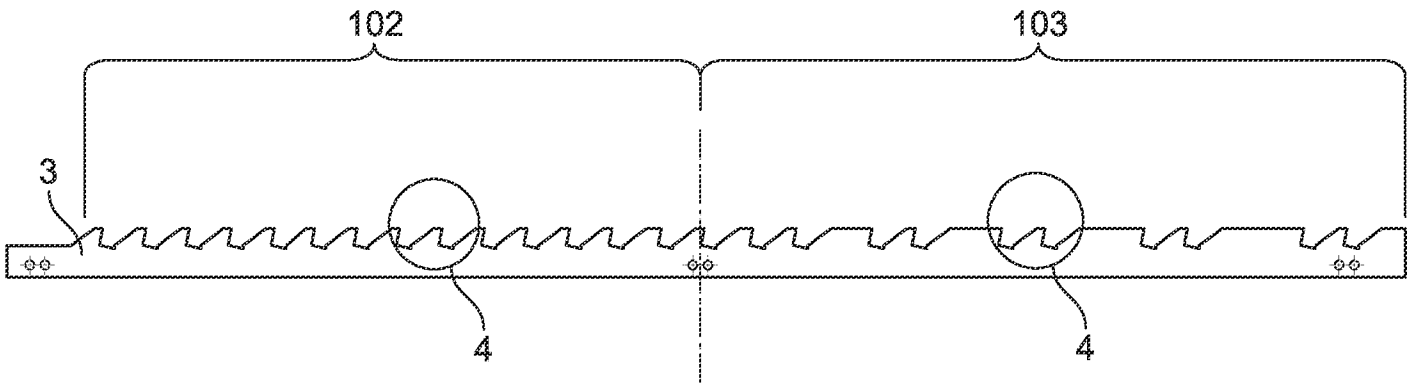
FIG. 4A depicts a side view of an example catch member.

FIG. 4A shows an example illustration of a side view of the catch member 3. At the starting height y1 (FIG. 3), the locking device 1 (FIGS. 1-3) is in a first partial region 102, in which the locking member 2 (FIG. 2) can engage the catches 4. In the first partial region 102 the catches 4 have substantially identical distances from each other. If the lifting platform 30 (FIG. 3) is lifted beyond the starting value y1, the locking device 1 moves to a second partial region 103, in which the pitch of the catches 4 (i.e., the distances between two adjacent catches 4) steadily increases in a longitudinal direction along a length of the catch member 3.

Figure 4B:
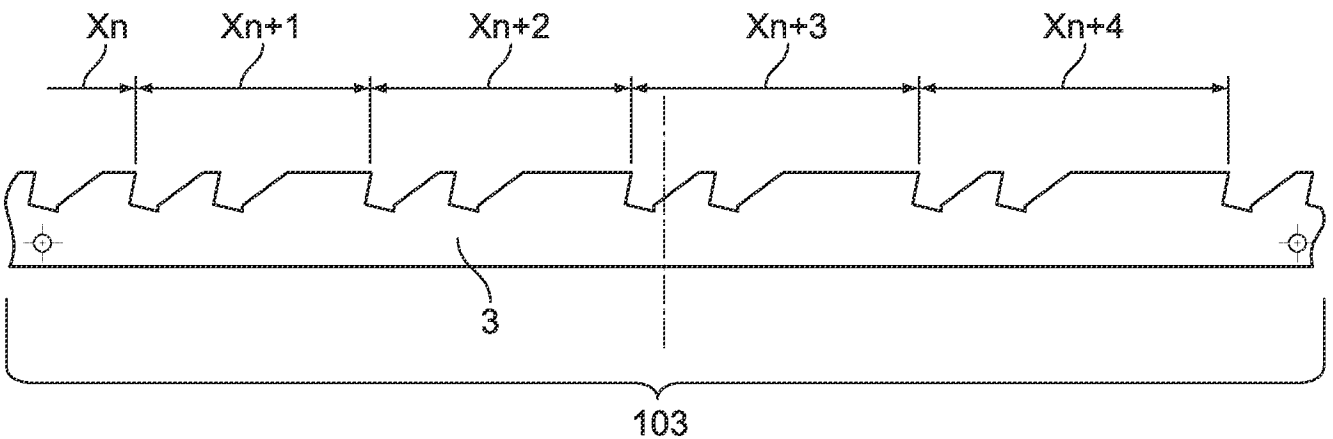
FIG. 4B depicts a side view of a second partial region of the example catch member of FIG. 4A.

For purposes of clarity, FIG. 4B shows an enlarged view of the second partial region 103 of the catch member 3. Distances between adjacent catches are shown in greater detail as increasing in a longitudinal direction along a length of the catch member 3 according to the length values xn+1, xn+2, xn+3.

The pitch $x_n(n)$ for n=1 . . . m may be determined using Equation (1) shown below:

$$x_n(n)=L_0-[\sqrt{l_{\mathrm{Arm}}^2-[y_1+(n\cdot y)]^2}]-[L_0-[\sqrt{l_{\mathrm{Arm}}^2-[y_1+[(n-1)\cdot y]]^2}]]. \quad (1)$$

In Equation (1) above, $l_{Arm}$ corresponds to the length of a scissors bar (e.g., the scissors bar 11 of FIG. 3) of a scissors-type lifting platform (e.g., the scissors-type lifting platform 30 of FIG. 3), $y_1$ corresponds to a starting height (shown in FIG. 3) and y corresponds to the fixedly predefined distances between the catching positions (shown in FIG. 3). Also in Equation (1), $L_0$ denotes the position of a first catch. The position $L_0$ of the first catch is based on the starting height $y_1$ and may be determined using Equation (2) below:

$$L_0=\sqrt{l_{\mathrm{Arm}}^2-y_1^2}. \quad (2)$$

A disclosed example locking device to releasably lock components that are movable relative to each other (e.g., in lifting devices) includes a locking mechanism mountable to a first component and having at least one locking unit. The example locking device also includes a catch member mountable to a second component. The catch member may have a plurality of substantially similarly formed catches, and the locking member is engageable to at least one catch in at least one of a releasable, form-locking manner and/or releasable, force-locking manner at a plurality of predetermined catching positions. Further, the example locking device may include a force member to produce a relative movement between the locking member and the at least one catch.

In at least a partial region of the catch member, at least a first catching position, a second catching position and a third catching position may be traversed and/or selected by the locking member. At least a first distance between the first catching position and the second catching position and a second distance between the second catching position and the third catching position may have different lengths. Thus, the number of possible catching positions can be reduced to a lower number of predetermined catching positions, thereby considerably reducing the expenditure of time for locating catching positions that produce equidistant lifting or vertical movements. By arranging the number of the catching positions in this manner, at least a first distance between the first catching position and the third catching position and a second distance between the second catching position and the first catching position may have different lengths.

In addition, the catch member may include a second partial region, in which a third distance between two adjacent catches and a fourth distance between two adjacent catches is the same, and a third partial region, in which a fifth distance between two adjacent catches and a sixth distance between two adjacent catches is different, wherein the length values of the distances between each two adjacent catches in the longitudinal direction along a length of the catch member continuously, regularly, discontinuously and/or irregularly increase or decrease. Thus, a plurality of different catching positions may advantageously be traversed and/or selected within a certain starting height, and only a lower number of predetermined catching positions can be adopted or selected outside of this starting height.

In addition, the first component may be connected to a third component and the second component may be connected to a fourth component, wherein the first component is displaceable relative to the second component by first movements, wherein the locking member is moved from the first catching position to the second catching position and/or to the third catching position, which is adjacent to the first and/or second catching positions, wherein at least two of these catching positions are located in the third partial region. Second movements of the third component relative to the fourth component may be effected based on the first movements. The catches corresponding to the catching positions may be spaced from each other such that the first movements have different lengths and the second movements always have the same lengths, wherein the first movements and the second movements are substantially perpendicular to each other. This enables the locking member to perform movements of different length in a lateral or horizontal direction, while movements of the same height are always performed in a vertical direction. Thus, the lifting platform or the rail of the lifting platform can advantageously adopt or catch at locking or arresting positions that always have equidistant distances to each other in a vertical direction, although the distances in a lateral or horizontal direction between the individual catching positions are different.

In addition, a guide unit may be provided in contact with the catch member such that the locking member can catch the catches of the catch member exclusively or selectively at predetermined catching positions. Thus, advantageously, the locking member can only catch with the catch member in predetermined catching positions, thereby preventing incorrect catching between the locking device and the catch member. In addition, the guide unit advantageously enables predetermining available or selectable catching positions in a catch member having adjacent catches with distances equal to each other over the entire length of the catch member so that only adjacently available or selectable catching positions having different lengths from each other are catchable. In similar manner, in the partial region of the catch member, in which adjacent catches have equal distances to each other, the guide unit may be used to enable the locking unit to only lock at catching positions having distances that are different from each other.

In addition, the guide unit may have an outer contour, and the locking member may have an actuation means to engage the contour of the guide unit at predetermined positions to prevent contact or catching between the locking member and the catch member at the predetermined positions. Thus, various catching positions are advantageously subsequently adjustable or adjustable at any time by modification of the outer contour or by use of an exchangeable guide means.

In addition, the force member can be a hydraulic cylinder, a stepper motor, an electromagnetic actuator, a spring member and/or a pneumatic cylinder.

In addition, the locking mechanism can have a dimensionally stable or uniform housing in contact with the locking member via a pivot joint. A first end region of the force member may be connected to the locking member, and a second end region of the force member may be connected to the housing.

In addition, the catch member may be a toothed rack and the catches may be teeth. The locking member may have at least one tooth that can engage the teeth of the toothed rack. Additionally or alternatively, the catch member may be a perforated rail.

In addition, the locking member may have at least a first tooth and/or at least a second tooth, each of which can engage a first catch unit and/or a second catch unit. Undesired engagement of the first tooth with the second catch unit may be prevented using the guide unit. Using a catch with two catch units and a locking member with two teeth advantageously enables dual engagement and ensures a secure arrest or lock.

In addition, a control unit may be provided to cause a drive assembly to produce a relative movement between the locking mechanism and the catch member. In this manner, a movement in a first direction causes a first predetermined position to be reachable and, after reaching the first predetermined position, a second movement in a second direction substantially opposite to the first direction causes a second predetermined position to be reachable. Thus, complete and secure locking or arresting of the locking mechanism with the catch member is enabled or ensured.

In addition, before and/or when the second predetermined position is reached, the control unit may drive the force member such that the locking member can engage a catch of the catch member in a form-locking manner and/or a force-locking manner, thus providing a locking or arresting position at the second predetermined position.

In addition, at least before and/or when the second predetermined position is reached, a force element may actuate the locking member such that the locking member can engage a catch of the catch member in a form-locking manner and/or a force-locking manner, thus providing a locking or arresting position at the second predetermined position.

In addition, to release the engagement between the locking member and a catch, the control unit may drive the drive assembly to produce a first movement in a first direction, and subsequently produce a second movement in a second direction that is substantially opposite to the first direction. After the end of the first movement and before the beginning of the second movement, and/or during the first or second movements, the force member is drivable by the control unit to release the form-locking engagement and/or the force-locking engagement of the locking member from a catch of the catch member. Thus, complete unlocking or releasing of the locking mechanism and the catch member may be enabled or ensured.

In summary, example locking devices disclosed herein provide at least the following advantages. Providing a catch member in which individual catches have different pitches relative to one another in at least a partial region of the catch member enables or ensures that predetermined lifting positions, in which a lifting platform can be locked or arrested, are separated from each other by equidistant, vertical distances even though the locking member moves along different path lengths from catching position to catching position in the lateral or horizontal direction. Providing a guide unit enables or ensures that no unintended catching of the locking member with the catch member can occur. This is particularly advantageous when using a locking member having first and second teeth and a catch having a first catch unit and a second catch unit, in which it would otherwise be possible for the second tooth to inadvertently catch with the first catch unit. This problem may occur when the force member applies insufficient pressure and the locking member is not completely retracted into the housing, thus, allowing the differently pitched second tooth of the locking member to become jammed on a second catch unit, resulting in a malfunction of the entire lifting platform. In addition, example locking devices disclosed herein prevent blocking of a lifting system by preventing incomplete unlocking of the locking mechanism, in which both teeth of the locking member would otherwise remain in contact with the catch.

All ranges of values specified in the present description also include the boundary values. The example features and example embodiments disclosed herein may be wholly or at least partially combined with each other in any suitable manner in order to form further embodiments, which may be adapted to corresponding applications of the example implementations disclosed herein.

Although certain example methods, apparatus, systems, and articles of manufacture have been described herein, the scope of coverage of this patent is not limited thereto. On the contrary, this patent covers all methods, apparatus, systems, and articles of manufacture fairly falling within the scope of the appended claims either literally or under the doctrine of equivalents.

What is claimed is:

1. A locking apparatus for releasably locking components movable relative to each other, comprising:

a locking device mountable to a first component and including at least one locking member;

a catch member mountable to a second component, the catch member having a plurality of substantially similarly formed catches, the locking member engageable with at least one catch in a plurality of predetermined catching positions in at least one of a releasable, form-locking manner or a releasable, force-locking manner;

a force member to produce a relative movement between the locking member and the at least one catch; and in at least a partial region of the catch member, at least a first catching position, a second catching position and a third catching position traversable by the locking member, at least a first distance between the first catching position and the second catching position and a second distance between the second catching position and the third catching position have different lengths, wherein the catch member is one of (1) a perforated rail or (2) a toothed rack and the catches are teeth, wherein the locking member has at least one tooth to engage the teeth of the toothed rack.

2. The locking apparatus according to claim 1, wherein the catch member includes a second partial region in which a third distance between two adjacent catches and a fourth distance between another two adjacent catches are the same, and includes a third partial region in which a fifth distance between two adjacent catches and a sixth distance between another two adjacent catches are different, wherein length values of distances between adjacent catches along a length of the catch member increase or decrease.

3. The locking apparatus according to claim 2, wherein:

the first component is connected to a third component, and the second component is connected to a fourth component, the first component being displaceable relative to the second component by first movements to move the locking member from the first catching position to at least one of the second catching position or the third catching position, the third catching position being adjacent to at least one of the first catching position or the second catching position, at least two of the first, second, or third catching positions being in the third partial region, and second movements of the third component relative to the fourth component being effected based on the first movements, the catches corresponding to the catching positions being spaced from each other such that the first movements have different lengths and the second movements have the same lengths, and the first movements and the second movements being substantially perpendicular to each other.

4. The locking apparatus according to claim 1, wherein:

the first component is connected to a third component, and the second component is connected to a fourth component, the first component being displaceable relative to the second component by first movements in which the locking member is moved from the first catching position to at least one of the second catching position or the third catching position, the third catching position being adjacent to at least one of the first catching position or the second catching position, and second movements of the third component relative to the fourth component being effected based on the first movements, the catches corresponding to the catching positions being spaced from each other such that the first movements have different lengths and the second movements have the same lengths, and the first movements and the second movements being substantially perpendicular to each other.

5. A lifting platform including the locking apparatus of claim 4, wherein the first component is a scissors bar, the second component is a bracket for the catch member, the third component is a garage floor or a base plate, and the fourth component is a rail.

6. The locking apparatus according to claim 1, further comprising a guide unit in contact with the catch member such that the locking member is selectively catchable in the catches of the catch member at predetermined catching positions.

7. The locking apparatus according to claim 6, wherein the guide unit includes an outer contour, the locking member including an actuation means to engage the outer contour of the guide unit at predetermined positions to prevent catching between the locking member and the catch member at the predetermined positions.

8. The locking apparatus according to claim 6, wherein the locking member includes at least a first tooth or a second tooth, both of which are structured to engage a first catch unit and a second catch unit, and the guide unit configured to prevent undesired engagement of the first tooth with the second catch unit.

9. The locking apparatus according to claim 1, wherein:

the locking mechanism includes a housing connected to the locking member via a pivot joint, and a first end region of the force member is in contact with the locking member and a second end region of the force member is in contact with the housing.

10. The locking apparatus according to claim 1, further comprising a control unit to cause a drive assembly to produce relative movement between the locking mechanism and the catch member, a first movement in a first direction causing a first predetermined position to be reachable and, after reaching the first predetermined position, a second movement in a second direction substantially opposite to the first direction causing a second predetermined position to be reachable.

11. The locking apparatus according to claim 10, wherein when reaching the second predetermined position, the control unit drives the force member to engage the locking member with one of the catches of the catch member in at least one of a form-locking manner or a force-locking manner, the second predetermined position corresponding to a locking position.

12. The locking apparatus according to claim 10, wherein the control unit is further to drive the drive assembly to release the engagement between the locking member and the catch to produce a third movement in the first direction and, subsequently, produce a fourth movement in the second direction substantially opposite to the first direction, wherein after the third movement and before the fourth movement, the control unit is to drive the force member to release the at least one of the form-locking engagement or the force-locking engagement of the locking member with the catch of the catch member.

13. A lifting platform including the locking apparatus of claim 1.

14. A method to releasably lock components movable relative to each other, comprising:

moving a locking device mounted to a first component along a length of a catch member mounted to a second component, the catch member having a plurality of substantially similarly formed catches;

engaging a locking member to at least one catch of a plurality of predetermined catching positions in at least one of a releasable, form-locking manner or a releasable, force-locking manner;

operating a force member to produce a relative movement between the locking member and the at least one catch; and in at least a partial region of the catch member, moving the locking member along at least a first catching position, a second catching position and a third catching position, at least a first distance between the first catching position and the second catching position and a second distance between the second catching position and the third catching position have different lengths, wherein the catch member is one of (1) a perforated rail or (2) a toothed rack and the catches are teeth, wherein the locking member has at least one tooth to engage the teeth of the toothed rack.

15. The method according to claim 14, further comprising:

moving the locking device along a second partial region of the catch member having two adjacent catches separated by a third distance and another two adjacent catches separated by a fourth distance, the third and fourth distances being the same; and moving the locking device along a third partial region of the catch member having two adjacent catches separated by a fifth distance and another two adjacent catches separated by a sixth distance, the fifth and sixth distances being different from one another, and wherein length values of distances between adjacent catches along the length of the catch member increase or decrease.

16. The method according to claim 14, further comprising:

moving the first component relative to the second component using first movements causing the locking member to move from the first catching position to at least one of the second catching position or the third catching position, the third catching position being adjacent to at least one of the first catching position or the second catching position; and moving a third component connected to the first component relative to a fourth component connected to a second component using second movements effected by the first movements, the catches corresponding to the catching positions being spaced from each other such that the first movements have different lengths and the second movements have the same lengths, and the first movements and the second movements being substantially perpendicular to each other.

17. The method according to claim 16, wherein the first component is a scissors bar, the second component is a bracket for the catch member, the third component is a garage floor or a base plate, and the fourth component is a rail.

18. The method according to claim 14, further comprising operatively coupling a guide unit to the catch member to cause the locking member to selectively catch the catches of the catch member at predetermined catching positions.

* * * * *